United States Patent [19]

Eskelinen et al.

[11] Patent Number: 4,905,380

[45] Date of Patent: Mar. 6, 1990

[54] METHOD AND APPARATUS IN A PAPER MACHINE SINGLE-WIRE DRYING GROUP

[75] Inventors: Pekka Eskelinen, Karhula; Raimo Virta; Vesa Vuorinen, both of Turku, all of Finland

[73] Assignee: Valmet Paper Machinery Inc., Finland

[21] Appl. No.: 238,758

[22] Filed: Aug. 30, 1988

[30] Foreign Application Priority Data

Sep. 2, 1987 [FI] Finland ..... 873812

[51] Int. Cl.[4] ..... F26B 3/00

[52] U.S. Cl. ..... 34/23; 34/115; 34/113; 34/116

[58] Field of Search ..... 34/115, 116, 117, 23; 162/290

[56] References Cited

U.S. PATENT DOCUMENTS 4,202,113 5/1980 Kankaanpaa ..... 34/116 X
4,483,083 12/1984 Chance ..... 34/116 X
4,553,340 12/1985 Petersson ..... 34/116 X

*Primary Examiner*—Henry A. Bennet

*Assistant Examiner*—John Sollecito

*Attorney, Agent, or Firm*—Steinberg & Raskin

[57] ABSTRACT

A single-wire drying group in a paper machine is disclosed including a plurality of drying cylinders whose axes are situated in a substantially common plane, a drying wire carrying a web between successive drying cylinders, one or more deflection rolls, each situated between a pair of successive drying cylinders and wherein the web-carrying drying wire has an incoming run from a drying cylinder to a deflection roll whereupon the drying wire runs over a deflection sector of the deflection roll and then to a subsequent drying cylinder. A blow box has a wall which defines a gap space with the incoming run of the web-carrying wire and a gas flow is directed through the gap space to induce an under pressure on the incoming run to fix the web on the drying wire. The deflection roll has a perforated shell in the perforations of which an underpressure is maintained to ensure that the web remains in contact with the outer surface of the drying wire as the drying wire travels over the deflection or closed sector of the deflection roll.

16 Claims, 6 Drawing Sheets

METHOD AND APPARATUS IN A PAPER MACHINE SINGLE-WIRE DRYING GROUP

BACKGROUND OF THE INVENTION

This invention relates generally to paper making machines and, more particularly, to methods and apparatus in single-wire drying groups in the drying sections of paper making machines.

Most multi-cylinder drying sections of paper machines comprise two rows of drying cylinders, one above the other, with the paper web traveling in a zigzag path between them. Air-permeable drying wires are generally used in modern installations.

The web is carried through the drying section in a single-wire and/or twin-wire conduction. In single-wire conduction drying sections, the same drying wire supports the web as it passes from one drying cylinder to another as well as on the run between the cylinder rows. In twin-wire conduction drying sections, separate upper and lower wires are used and the web has a free, unsupported run as it travels from one cylinder row to the other.

One of the drawbacks of conventional multi-cylinder drying sections wherein single-wire conduction is used is the tendency of the web to become detached from the surface of the drying wire on those cylinders where the web is situated on the outer surface of the drying wire. This tendency to separate from the drying wire is increased by the overpressures which are induced in the entrance nips formed between the drying wire and cylinder surfaces. Detachment of the web from the drying wire may result in web breakage or, at the least, in bagging and wrinkling of the web.

Regarding the state of the art to which this invention pertains, reference is made to DE-OS No. 31 32 040 and to Finnish patents Nos. 69143 and 70275, all of J.M. Voith GmbH, as well as to Finnish patent application Nos. 812089, 851533 and 862413. The last-mentioned patent application discloses drying groups in which the distances between the peripheries of the drying cylinders and the gaps between drying cylinders and suction-deflection rolls are minimized, and the diameters of the drying cylinders and the diameters of the suction-deflection rolls are selected such that the covering sectors of the web-carrying drying wire are within the range of between about 210° and 270°, most preferably between about 240° and 260°.

The trend in design of single-wire conduction drying sections are constructions wherein the steam-heated lower drying cylinders are replaced by smaller diameter lower cylinders which may be non-heated or guide rolls. This, in combination with the trend towards increasing paper machine speeds, imposes particularly high standards for arrangements by which positive contact of the web with the wire surface is maintained when the web is positioned on the outer surface of the curved deflection sector of the lower roll.

The present invention relates to drying sections including single-wire type drying groups. In particular, the invention relates to a single-wire drying group of a multi-cylinder dryer comprising a plurality of drying cylinders having axes substantially situated in a common plane and located outside the loop of the drying wire. The web-carrying drying wire is conducted over covering sectors of the drying cylinders, preferably having an extent greater than 180°, and deflection rolls or the like are arranged between successive drying cylinders within the loop of the drying wire, the web-carrying drying wire passing over a deflection sector of the deflection roll with the web situated on the outer surface of the drying wire.

SUMMARY OF THE INVENTION

An object of the present invention is to provide new and improved methods and apparatus in single-wire drying groups of paper machine drying sections.

Another object of the present invention is to provide new and improved methods and apparatus in single-wire drying groups in which the web is more reliably maintained in contact with the outer surface of the drying wire as the drying wire travels over the deflecting sector of a guide or deflection roll or cylinder.

Still another object of the invention, desirable but not essential, is to provide new and improved methods and apparatus in single-wire drying groups wherein the introduction of the web end into the single-wire drying group does not require a rope construction. This is advantageous in that recently designed paper machines provide closed or supported runs of the web between the press and drying sections so that the web has no free runs throughout which would enable the necessary lateral shifting of the end conduction strip of the web into the throat of the rope construction.

Other objects of the invention will become apparent from the following description.

Briefly, in accordance with the method of the invention, these and other objects are attained by providing a method wherein the web, upon leaving the surface of the drying cylinder, is initially supported by an underpressure induced on the run of the web-carrying drying wire by means of an ejection air flow. The underpressure may be produced in the gap formed between the run of the drying wire and wall of a blow box.

Subsequent to the web supporting phase described above, the drying wire and web adhering to its outer surface are supported on the deflection sector of a deflection roll or the like by means of an underpressure produced in the perforations of the shell of the deflection roll.

The underpressure in the perforations in the shell of the deflection roll is reinforced and/or created by closing and/or producing an underpressure zone in communication with the open sector of the deflection roll, i.e., the sector of the deflection roll which is not covered by the web-carrying drying wire.

The web is then conducted, supported on the drying wire, in a substantially straight run from the deflection roll to the next heated drying cylinder.

In accordance with the apparatus of the invention, the objects mentioned above, as well as others, are obtained by providing a single-wire drying section having a construction as described above in connection with the description of the method of the invention. In accordance with the illustrated embodiments, the single-wire drying group includes one or more blow or blow/suction boxes, each located in an inter-cylinder region between a pair of successive drying cylinders. Each blow box has a substantially planar wall facing a respective incoming run of the web-carrying drying wire and nozzle means through which an ejection gas flow is directed in a direction opposite to the direction of travel of the incoming run of the web-carrying wire to induce an underpressure in the gap space between the blow box wall and the incoming run of the drying wire and in the following nip or wedge gap defined by the incoming drying wire run and the deflection roll. The blow or blow/suction box includes a suction and/or sealing section which covers the open sector of a respective deflection roll between adjacent wedge gaps or nips. As noted above, the deflection rolls, which may be unheated rolls or cylinders, are provided with a perforated shell.

The zone of underpressure acting on the web in the region of the single-wire conduction in accordance with the invention extends to the nip formed between the straight incoming run of the drying wire and the deflection roll and further to the deflection sector of the deflection roll, i.e., the sector of the deflection roll shell on which the web-carrying drying wire is guided with the web on the side of the outer curved surface of the drying wire. The zone of underpressure may also be extended, if desired, to the outgoing straight run of the web-carrying drying wire from the deflection roll to the next heated drying cylinder.

In accordance with the invention, each deflection roll utilizes a perforated shell in the perforations of which a reduced pressure is provided by the rotational centrifugal forces of the deflection roll and/or by particular suction arrangements, which will ensure that the web remains in contact with the drying wire while traveling on the outer side of the drying wire over the deflection sector of the deflection roll without the need for any additional support.

DESCRIPTION OF THE DRAWINGS

A more complete appreciation of the present invention and many of the attendant advantages thereof will be readily understood by reference to the following detailed description when considered in connection with the accompanying drawings in which preferred embodiments of the invention are illustrated to which the invention is not limited.

DESCRIPTION OF THE PREFERRED EMBODIMENTS

Figure 1:
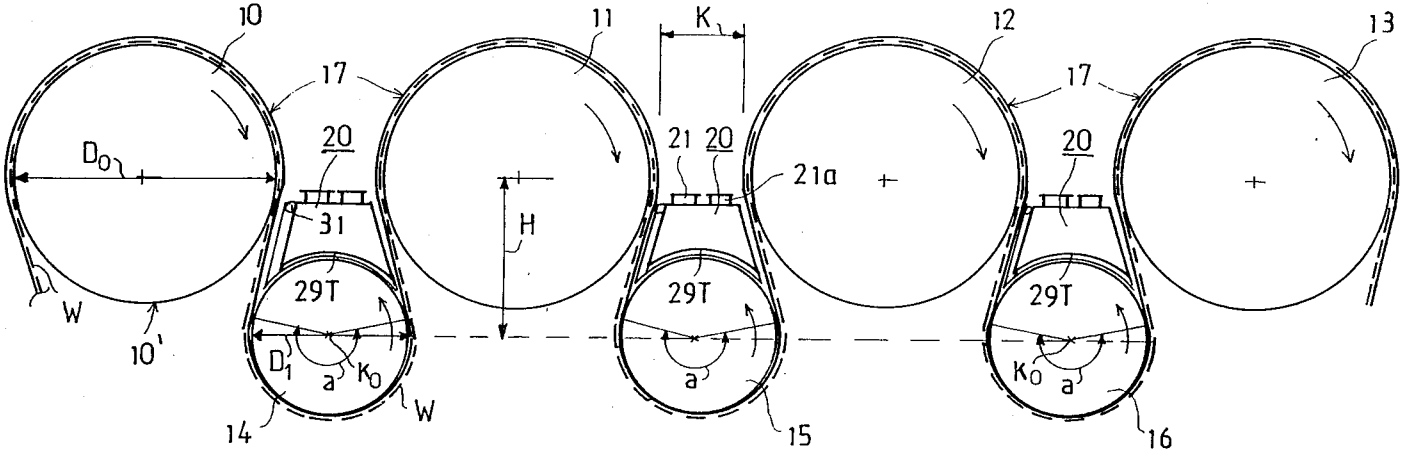
FIG. 1 is a schematic side elevation view of a single-wire conduction drying group in a drying section in accordance with the invention.

Referring now to the drawings wherein like reference characters designate identical or corresponding parts throughout the several views, and more particularly to FIG. 1, a drying group is illustrated which includes a horizontal row of steam-heated drying cylinders 10, 11, 12 and 13. A drying wire 17 carries a paper web W on its outer surface and carries the web through the drying group. The web is situated between the heated surfaces of the drying cylinders and the drying wire so that the latter presses the web against the heated surfaces to produce an evaporation drying effect. Non-heated deflection or guide cylinders or rolls 14, 15 and 16 are situated below the drying cylinders 10–13 and are each situated in the inter-cylinder region between a pair of successive drying cylinders. The deflection rolls are provided with suction or deflection zones a or equivalent arrangements for reliably holding the web W on the outer surface of the drying wire 17 even at high speeds of operation.

The drying cylinder group illustrated in FIG. 1 may be, for example, the first drying group in the drying section of the paper machine in which case the web W is preferably carried from the press section of the paper machine (not shown) to the drying section in a closed run on drying wire 17. In a typical embodiment of a drying section, one or more single-wire groups of the type shown in FIG. 1 may follow the initial drying group, and thereafter, one or more twin-wire drying groups may be provided if required.

Each of the lower deflection rolls or cylinders 14, 15 and 16 are provided with a shell 18 in which perforations 19 are formed at least in regions over which the web W extends in the cross-machine direction.

In the embodiments illustrated in FIGS. 2–6, combined blow-suction boxes 20 are provided in the inter-cylinder regions between pairs of successive cylinders 10,11; 11,12; and 12,13. The upper, free or open sectors of the deflection rolls 14,15 and 16 are covered by components of the blow-suction boxes 20.

Referring to FIGS. 2–6, the embodiments of the blow-suction boxes 20 generally all comprise an upper wall 28, side walls 25 and 26, and vertical end walls 29*a* and 29*b* (FIG. 6), which have curved bottom edges 29V having a profile corresponding to the curve of the outer surface of shell 18 of deflection rolls 14, 15 and 16 and spaced therefrom by a distance V. If required, sealing strips 29T acting on the outer surface of shell 18 may be provided in conjunction with the lower edges 29V. In this case, the perforations 19 of shell 18 all lie between the sealing strips and in any case are situated between the edges 29V.

Figure 2:
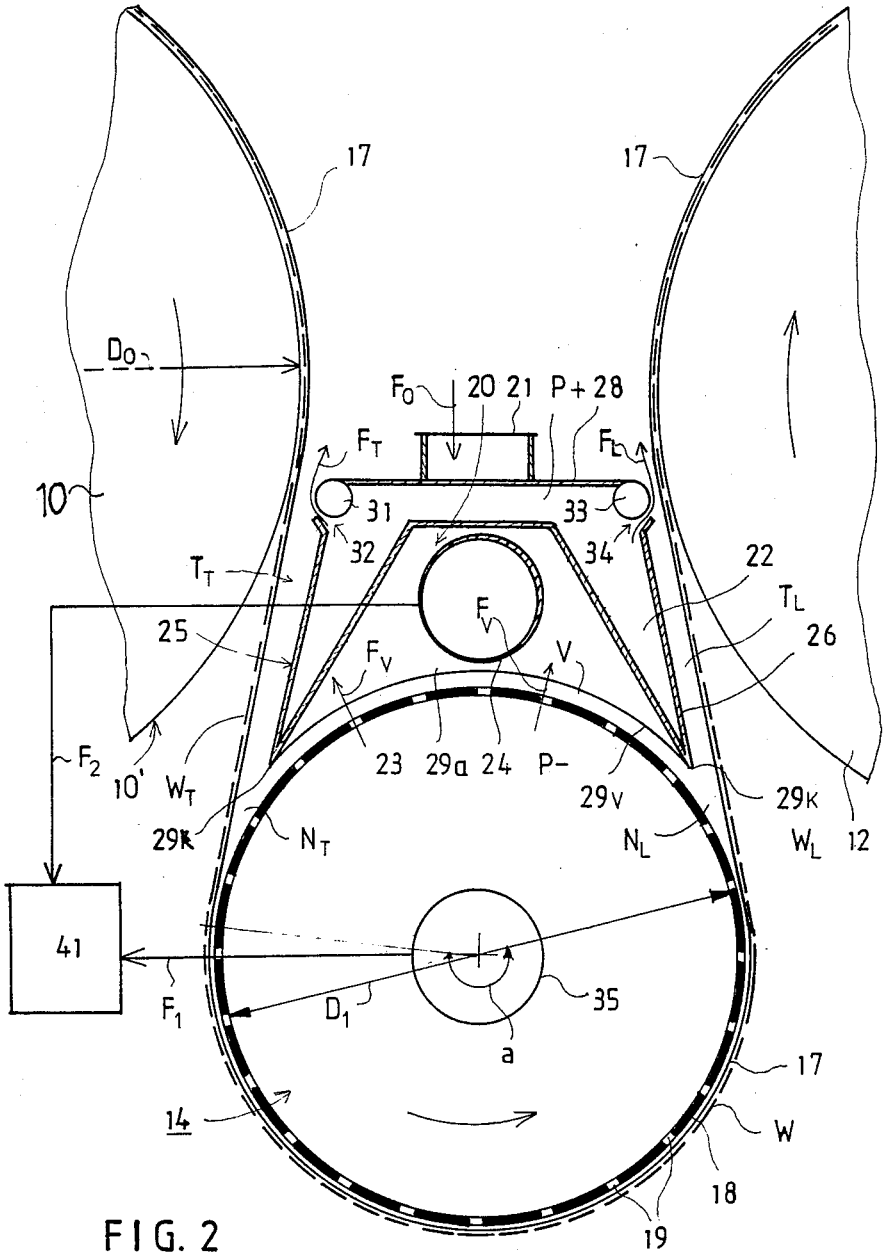
FIG. 2 is a view of a part of the drying group illustrated in FIG. 1 on an enlarged scale and illustrating an external blow/suction box and a suction connector provided in conjunction with the journal pin of the deflection roll.

Referring now to the embodiment of FIG. 2, the suction-blow box 20 has an overpressure compartment 22 in which an overpressure P+ is maintained by means of a gas flow $F_o$ introduced through connector 21. Ejection air flows $F_T$ and $F_L$ are directed through nozzle slits 32 and 34 of the suction-blow box 20. The ejection gas flows $F_T$ and $F_L$ induce an underpressure in the gap spaces $T_T$ and $T_L$ defined by the walls 25 and 26 of blow-suction box 20 and respective opposed incoming and outgoing straight runs of the web-carrying wire 17. The underpressures in these gap spaces ensure that the web W is reliably held on the surface of the drying wire 17 on both the incoming and outgoing runs thereof with respect to the deflection roll 14. The zones of underpressure also contribute to ensuring that a sufficiently low pressure exists in both the incoming nip $N_T$ and the outgoing nip $N_L$ between the deflection roll 14 and the drying wire 17 to thereby reliably hold the web W on the outer surface of the wire 17.

The ejection gas flow $F_T$ is directed parallel to the plane of the web-carrying wire 17 at that point in a direction opposite to the direction of its travel, while the ejection gas flow $F_L$ on the outgoing side is directed parallel to the plane of the web-carrying wire 17 at that point, but in the same direction as the wire is traveling. The nozzle slits 32 and 34 are preferably arranged as Coanda nozzles and are formed between the outwardly bent marginal ends of the walls 25 and 26 and tubular section 31 and 33. Nozzle slits 32 and 34 extend transversely to the run of web W over its entire width. The size of the nozzle slits is preferably in the range of between about 1 an 5 mm and the velocities of the ejection gas flows $F_T$ and $F_L$ are preferably in the range of between about 15 and 60 m/s.

Still referring to FIG. 2, a separate suction compartment 23 is provided within the suction-blow box 20 opening onto the open sector of the deflection roll 14 between the nips $N_T$ and $N_L$. The lowermost points 29K of the curved edges 29V of end walls **29*a* and 29*b*, which comprise the lowermost edges of the suction compartment 23, preferably extend as deeply as possible into the nips $N_T$ and $N_L$. An underpressure P− is maintained in the suction compartment 23 by means of a suction connector 24 coupled to a vacuum pump 41 whereby a suction flow $F_2$ is produced. The underpressure P− acts in the direction of arrows $F_V$ on the perforations 19 of shell 18 of the deflection roll 14. The underpressure in perforations 19 is partially maintained in the nips $N_T$ and $N_L$ by the action of the ejection gas flows $F_T$ and $F_L$. Consequently, on the deflection sector a of the deflection roll 14 where the web W is supported on the outer surface of the drying wire 17, the underpressure in the perforations 19 act on the web W through the relatively permeable drying wire 17 thereby ensuring a reliable adherence of the web W to the outer surface of the drying wire 17, even at high speeds and even where the radius of curvature $D_1/2$ of deflection roll 14** is small.

The interior space within perforated shell 18 of the deflection roll 14 is also coupled to the suction pump 41 through a suction connector 35 provided on the journal pin of deflection roll 14. A suction gas flow $F_1$ is thereby created to boost the underpressure created and maintained in the perforations 19 of the shell 18 of deflection roll 14.

Figure 3:
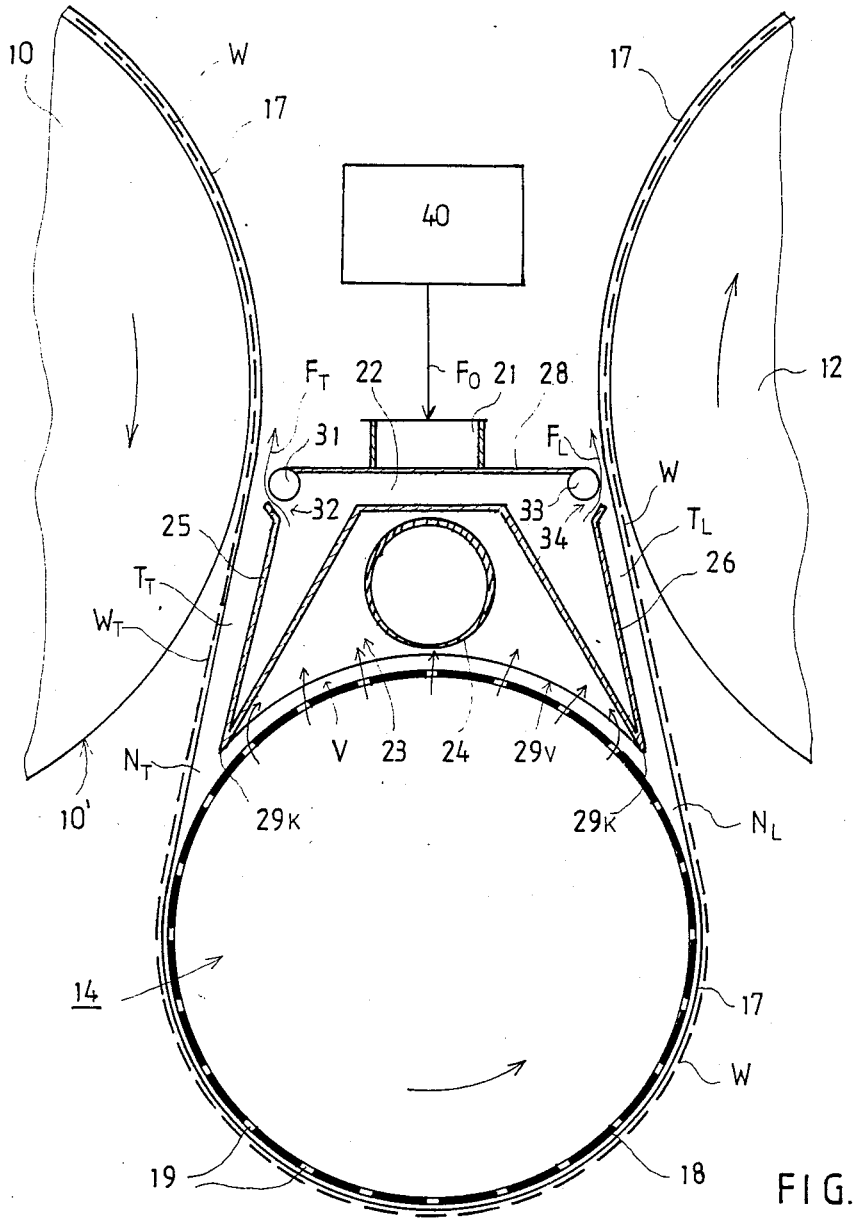
FIG. 3 is a view similar to FIG. 2 illustrating a modification in which a suction connector of the type illustrated in FIG. 1 is omitted.

Referring now to FIG. 3, an embodiment of the invention similar to that of FIG. 2 is illustrated, but which differs therefrom in that the suction connector 35 mounted on the journal pin of deflection roll of the FIG. 2 embodiment is omitted. Rather, the underpressure is created and maintained in the perforations 19 solely by means of the centrifugal pumping resulting from the rotation of the deflection roll and the underpressure compartment 23 of blow-suction box 20. Additionally, a blower 40 is illustrated in FIG. 3 from which the overpressure creating gas flow $F_0$ is directed into the overpressure compartment 22. The construction of the embodiment of FIG. 3 is in other respects similar to that described above in connection with FIG. 2.

Figure 4:
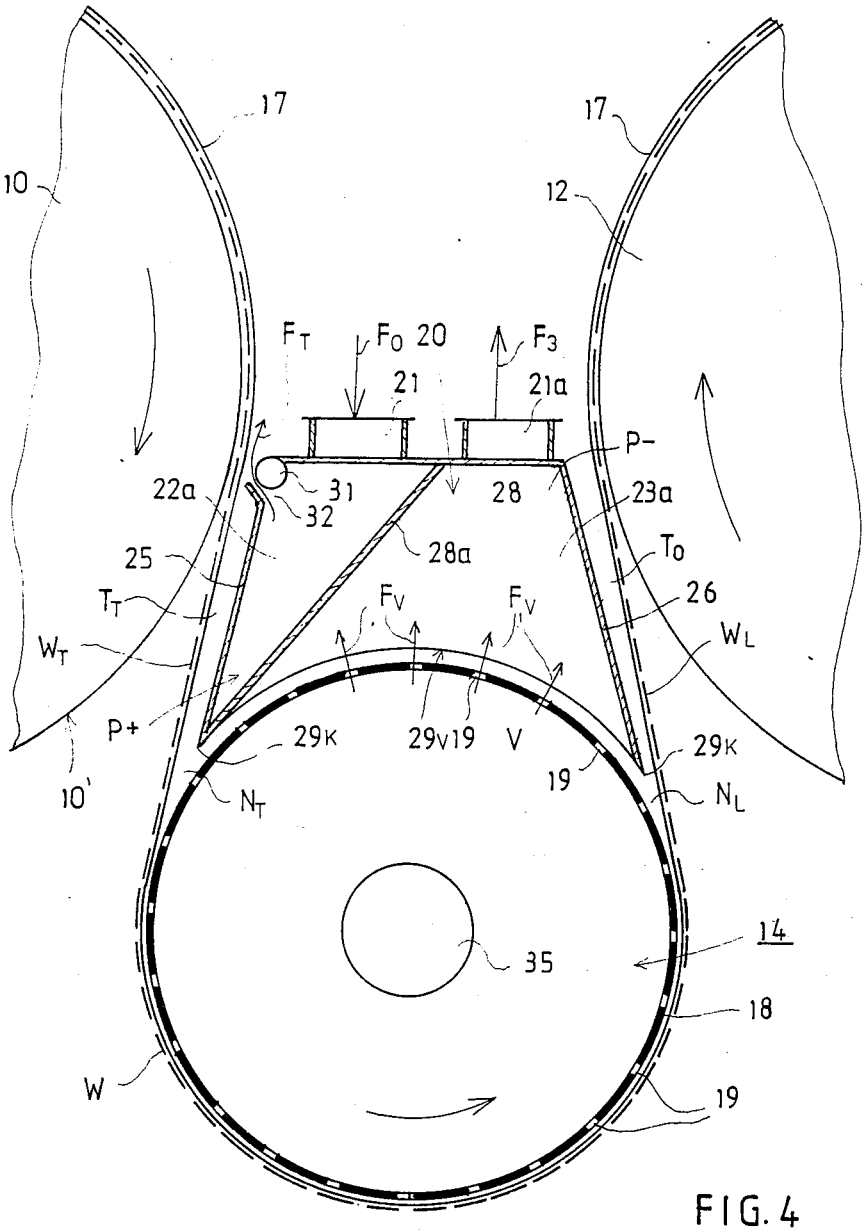
FIG. 4 is a view similar to FIGS. 2 and 3 and illustrating a modification in which an underpressure zone on the outgoing run of the web-carrying drying wire traveling from the deflection roll to the next drying cylinder is omitted.

Referring now to FIG. 4, an embodiment of the invention is illustrated in which an overpressure gas flow connector 21 and an underpressure gas flow connector **21*a* are provided in the end wall 28 of suction-blow box 20. Connectors 21 and 21*a* communicate with separate overpressure and underpressure compartments 22*a* and 23*a* which are separated from each other by a partition 28*a*. An ejection air flow $F_T$ is produced by the overpressure maintained in overpressure compartment 22*a* which induces an underpressure zone in the gap space $T_T$ which extends into the entrance nip $N_T$. The suction gas flow $F_3$ through connector 21*a* maintains an underpressure P− in the suction compartment 23*a* which, together with the centrifugal effect produced by the rotation of deflection roll 14, generates suction air flows $F_V$ through the perforations 19 in the open sector of the shell 18 of deflection roll 14. In this embodiment, an underpressure zone is not induced on the outgoing run of drying wire 17. However, a small underpressure is inherently produced in the gap space $T_0$ due to the boundary layer airflow induced by the movement of the drying wire 17. The journal pin of deflection roll 14 supports a suction connector 35 by which the underpressure in perforations 19 of shell 18 is maintained and possibly boosted. In other respects, the design and operation of the apparatus illustrated in FIG. 4** are similar to those previously described.

Figure 5:
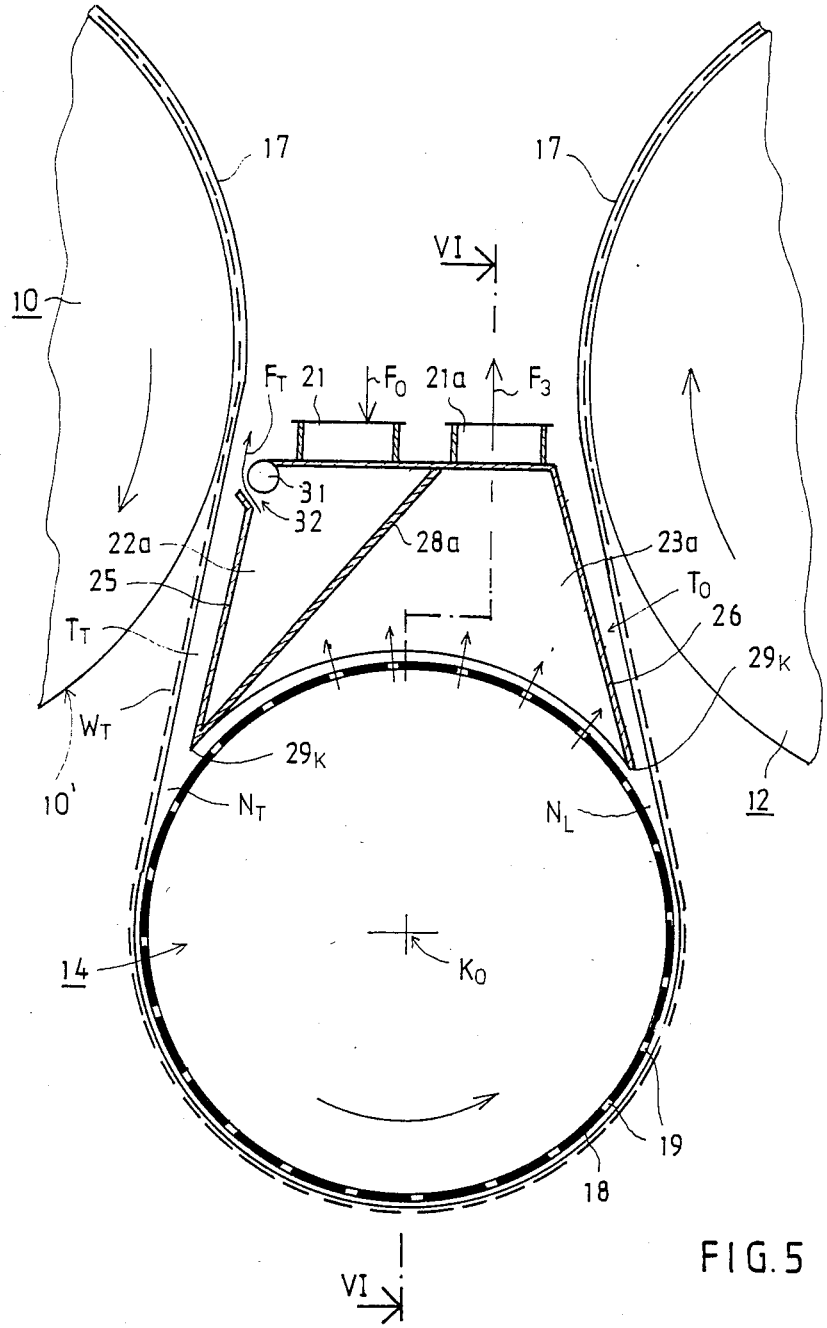
FIG. 5 is a view similar to FIGS. 2, 3 and 4 of a modification of the embodiment of FIG. 4 wherein the journal pin suction connector of FIG. 4 is omitted.
Figure 6:
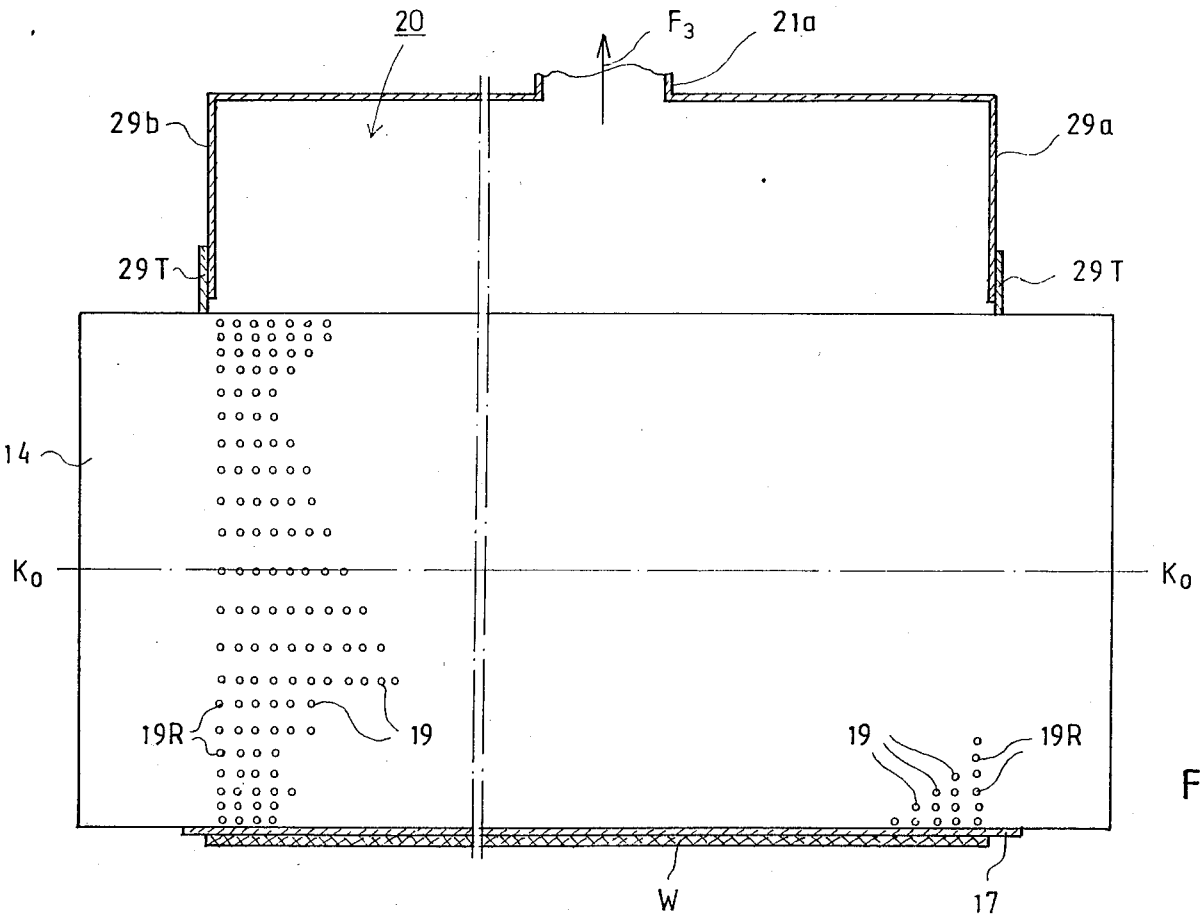
FIG. 6 is a section view taken along line VI—VI of FIG. 5.

Referring now to FIGS. 5 and 6, the suction-blow box illustrated therein is similar to that illustrated in FIG. 4 and described above except that the suction connectors mounted on the journal pin are omitted. Rather, an underpressure in the perforations 19 of shell 18 of deflection roll 14 is maintained by the centrifugal pumping induced by the rotation of the shell 18 and by the underpressure in the suction compartment **23*a***.

A vertical partition or partitions can be provided in the deflection roll 14 and/or in the suction-blow box 20 so that underpressure may be boosted in selected areas across the web W such, for example, as during end conduction. A greater underpressure is obtained in the box 20 in the areas confined by such partitions, such as by closing the suction apertures of other areas. Such partitions may be mounted so as to be either fixed or moveable in the transverse direction. When the partitions are fixed, no stationary components are required within the deflection roll 14 which complicates the construction due to the necessity of support. Reference is made to the above-mentioned Finnish patent application No. 862413 for details of the construction of the partitions.

It is within the scope of the invention to provide that the box 20 merely closes the open sector of the deflection roll 14. The underpressure in perforations 19 is created and maintained in this case by means of a suction connector provided on the journal pin of a cylinder, or merely under the effect of the centrifugal pumping induced by the rotation of the shell 18.

The percentage R of the total perforated area of the shell 18 for which the cross-sectional area of the perforation 19 of the deflection roll 14 parallel to the shell 18 accounts is generally in the range of between about 5 to 40 percent and, preferably, in the range of between about 10 to 30 percent.

The underpressure P− maintained in the suction compartment 23, **23*a* of the box 20** is generally in the range of between about −200 to −2000 $P_a$, preferably in the range of between about −400 to −1000 $P_a$.

The overpressure P+ maintained in the overpressure compartment 22, **22*a* is generally in the range of between about 400 to 2000 $P_a$, preferably in the range of between about 600 to 1000 $P_a$. The dimensions $D_0$, $D_1$, H and K shown in FIG. 1** are generally within the following ranges:

Do=about 1500 to 2000 mm
Di=about 500 to 1500 mm
H=about 500 to 1000 mm
K=about 300 to 1000 mm The symbol H refers to the difference in height between a plane containing the axes of drying cylinders 10–13 and a plane containing the axes of the deflection rolls 14–16.

The arrangement of the invention is also advantageous in that the perforations 18 in the deflection rolls are in effect preloaded with an underpressure as they rotate into the deflection sector over which the web-carrying drying wire passes with the web W carried on its outer surface.

The invention provides in a novel and advantageous manner, a combination of underpressure zones created and maintained by different mechanisms to reliably maintain the support of the web on drying wire 17, from the smooth surface 10′ of drying cylinder 10 to the corresponding smooth surface of the next drying cylinder 11, while traveling over paths having sharp curves at high speeds.

Obviously, numerous modifications and variations of the present invention are possible in the light of the above teachings. Therefore, it is to be understood that within the scope of the claims appended hereto, the invention may be practiced otherwise than as specifically disclosed herein.

What is claimed is:

1. In a multi-cylinder drying section of a paper machine, a single-wire drying group comprising the combination of:

a looped drying wire;

a plurality of successively arranged drying cylinders located outside said drying wire loop having respective axes of rotation situated in a substantially common plane, said drying wire carrying a web between successive drying cylinders and passing over a covering sector of each of said drying cylinders with the web interposed between said drying wire and a heated drying surface of said drying cylinder;

at least one deflection roll having a perforated shell with perforations thereof extending through said shell and communicating with an interior of said roll, each deflection roll located within said drying wire loop in an inter-cylinder region between a pair of successive drying cylinders, said web-carrying drying wire having an incoming run traveling from a first one of said pair of successive drying cylinders to said deflection roll whereupon said drying wire runs over a deflection sector of said deflection roll shell, said incoming run of said web-carrying drying wire and said deflection roll shell defining a first wedge-shaped space or nip at the end of said incoming run, said deflection roll shell having an open sector free of said web-carrying drying wire;

at least one box means, each located in a respective inter-cylinder region proximate to said deflection roll, for directing a first ejecting gas flow adjacent to said incoming run of said web-carrying drying wire in a direction opposite to the direction of travel thereof for inducing a first underpressure on said incoming run and in a space including said first wedge-shaped space, and for covering said open sector of said deflection roll by at least one of a closing compartment and an underpressure compartment of said box means.

2. The combination of claim 1 wherein said at least said one box means are located below said drying cylinders.

3. The combination of claim 1 wherein said at least one box means each comprises a substantially planar first wall in spaced opposed relationship with a respective incoming run of said web-carrying drying wire and forming a first gap space therewith, and first nozzle means situated in a region of said first planar wall through which said first ejecting gas flow is directed wherein said first ejecting gas flow induces said first underpressure in said first gap space and said first wedge-shaped space.

4. The combination of claim 3 wherein said web-carrying drying wire has an outgoing run traveling from said deflection roll to a second one of said pair of successive drying cylinders, said outgoing run of said web-carrying drying wire and said deflection roll defining a second wedge-shaped space at the beginning of said outgoing run, and wherein said box means each comprises a substantially planar second wall in spaced opposed relationship with a respective outgoing run of said web-carrying drying wire and forming a second gap space therewith, and second nozzle means situated in a region of said second planar wall through which a second ejecting gas flow is directed and wherein said second ejecting gas flow induces a second underpressure in said second gap space acting on said outgoing run of said web-carrying drying wire.

5. The combination of claim 3 wherein said at least one box means each comprise an overpressure compartment and an underpressure compartment, said underpressure compartment opening onto and communicating with said open sector of said deflection roll shell substantially covering said open sector and means for communicating said underpressure compartment with an external suction source.

6. The combination of claim 1 further including connector means provided in said deflection roll for communicating the interior of said deflection roll with a source of suction from maintaining an underpressure in said perforations in said deflection roll shell.

7. The combination of claim 6 wherein said connector means are mounted on a journal pin of said deflection roll.

8. The combination of claim 1 wherein said perforations are formed along a length of said deflection roll shell within the cross-machine width of the web, and wherein the area of said perforations comprises about 5% to 40% of the total area of the surface of said perforated shell.

9. The combination of claim 8 wherein the area of said perforations comprises about 10% to 30% of the total area of the surface of said perforated shell.

10. The combination of claim 1, wherein contact of the web with the drying wire while traveling on an outer side of the drying wire over said deflection sector of said deflector roll, is ensured without any need for additional support.

11. A method in a single-wire drying group of a multi-cylinder drying section of a paper machine including a plurality of successively arranged drying cylinders having respective axes of rotation situated in a substantially common plane, at least one deflection roll having a perforated shell with perforations thereof extending through said shell and communicating with an interior of said roll, located in an inter-cylinder region between a pair of successive drying cylinders, a web-carrying looped drying wire conducted so that said drying cylinders lie outside and said at least one deflection roll lies inside the loop of the drying wire, said drying wire carrying the web over covering sectors of said drying cylinders with said web situated between the drying cylinder surfaces and the drying wire and over a deflection sector of each of said at least one deflector rolls with said web situated on an outer side of said drying wire, comprising the combination of steps of:

as the web-carrying drying wire departs from a first one of a pair of successive drying cylinders and travels over an incoming substantially straight run towards said deflection roll, maintaining the web supported on said incoming drying wire run by inducing a first underpressure on the incoming run said web-carrying drying wire by an ejection gas flow, said first underpressure being induced in a first gap space defined between said incoming drying wire run and a first wall of a blow box; and maintaining the web supported on the outer surface of said drying wire over said deflection sector of said deflection roll by creating and maintaining an underpressure in said perforations formed through said shell of said deflection roll;

maintaining said perforation underpressure in said perforations by at least one of the steps of closing a free sector of said deflection roll not covered by said web-carrying drying wire and communicating said free sector with an underpressure zone; and conducting said web-carrying drying wire from said deflection roll to the second one of said pair of successive drying cylinders.

12. The method of claim 11 wherein said blow box comprises a suction-blow box situated proximate to said open sector of said deflection roll including nozzle means for directing said first ejection gas in a direction opposite to the direction of travel of said web-carrying drying wire, and wherein the step of maintaining the perforation underpressure in said perforations includes at least the step of creating an underpressure zone in said suction-blow box in communication with said free sector of said deflection roll.

13. The method of claim 12 including the further step of maintaining the web supported on an outgoing run of said drying wire traveling from said deflection roll to a second one of said pair of successive drying cylinders by directing a second ejection gas flow from said suction-blow box substantially parallel to and in the said direction as said outgoing drying wire run to induce a second underpressure in a second gap space defined between said outgoing drying wire run and a second wall of said suction-blow box.

14. The method of claim 11 wherein said perforation underpressure in said perforations of said deflection roll are at least partially created and maintained by connecting said deflection roll to a vacuum source by suction connectors.

15. The method of claim 11 wherein an underpressure is created and maintained in an incoming nip defined between said incoming drying wire run and said deflection roll by said first ejection gas flow and said underpressure maintained in said perforations.

16. The method of claim 13 wherein an underpressure is created and maintained in an outgoing nip defined between said outgoing drying wire run and said deflection roll by said second ejection gas flow and said underpressure maintained in said perforations.

* * * * *